United States Patent [19]

Ruottu

[11] Patent Number: 5,019,137

[45] Date of Patent: May 28, 1991

[54] METHOD FOR CLEANING GASES CONTAINING CONDENSABLE COMPONENTS

[75] Inventor: Seppo K. Ruottu, Kotka, Finland

[73] Assignee: A. Ahlstrom Corporation, Karhula, Finland

[21] Appl. No.: 508,497

[22] Filed: Apr. 12, 1990

Related U.S. Application Data

[63] Continuation of Ser. No. 852,950, filed as PCT FI85/00074 on Aug. 30, 1985, published as WO86/01822 on Mar. 27, 1986, abandoned.

[30] Foreign Application Priority Data

Sep. 14, 1984 [FI] Finland ..... 843606

[51] Int. Cl.[5] ..... B01D 53/12

[52] U.S. Cl. ..... 55/73; 55/77; 55/82; 55/269; 55/390

[58] Field of Search ..... 55/77, 80, 82, 18, 71, 55/72, 73, 267, 269, 390

[56] References Cited

U.S. PATENT DOCUMENTS

| | | | |
|---|---|---|---|
| 2,583,013 | 1/1952 | Patterson | 55/82 |
| 3,443,360 | 5/1969 | Reeves | 55/71 |
| 4,078,041 | 3/1978 | Morris | 55/2 X |
| 4,120,668 | 10/1978 | Fraley | 55/72 |
| 4,135,893 | 1/1979 | Roberts | 55/82 |
| 4,198,212 | 4/1980 | Tsao | 48/210 |
| 4,303,127 | 12/1981 | Freel et al. | 55/80 X |
| 4,334,898 | 6/1982 | Zhuber-Okrog et al. | 55/82 X |
| 4,372,937 | 2/1983 | Johnson | 55/80 X |
| 4,412,848 | 11/1983 | Koyama et al. | 55/80 X |
| 4,461,629 | 7/1984 | Arisaki | 55/80 X |

FOREIGN PATENT DOCUMENTS

| | | |
|---|---|---|
| 0127878 | 12/1984 | European Pat. Off. . |
| 3023480 | 1/1982 | Fed. Rep. of Germany . |
| 384844 | 5/1976 | Sweden . |
| 390892 | 1/1977 | Sweden . |
| 2140144 | 8/1986 | United Kingdom . |

*Primary Examiner*—Robert Spitzer
*Attorney, Agent, or Firm*—Nixon & Vanderhye

[57] ABSTRACT

Gases containing tar and other condensable components are cleaned by cooling them in a circulating fluidized bed reactor (2) provided with cooling surfaces (8). Into the fluidized bed reactor are led solids separated from the cooled gas in a cyclone separator (3) and other solids. Tar and other compounds condense on the solids in a mixing chamber (9) disposed before the cooling surface in the reactor.

21 Claims, 1 Drawing Sheet

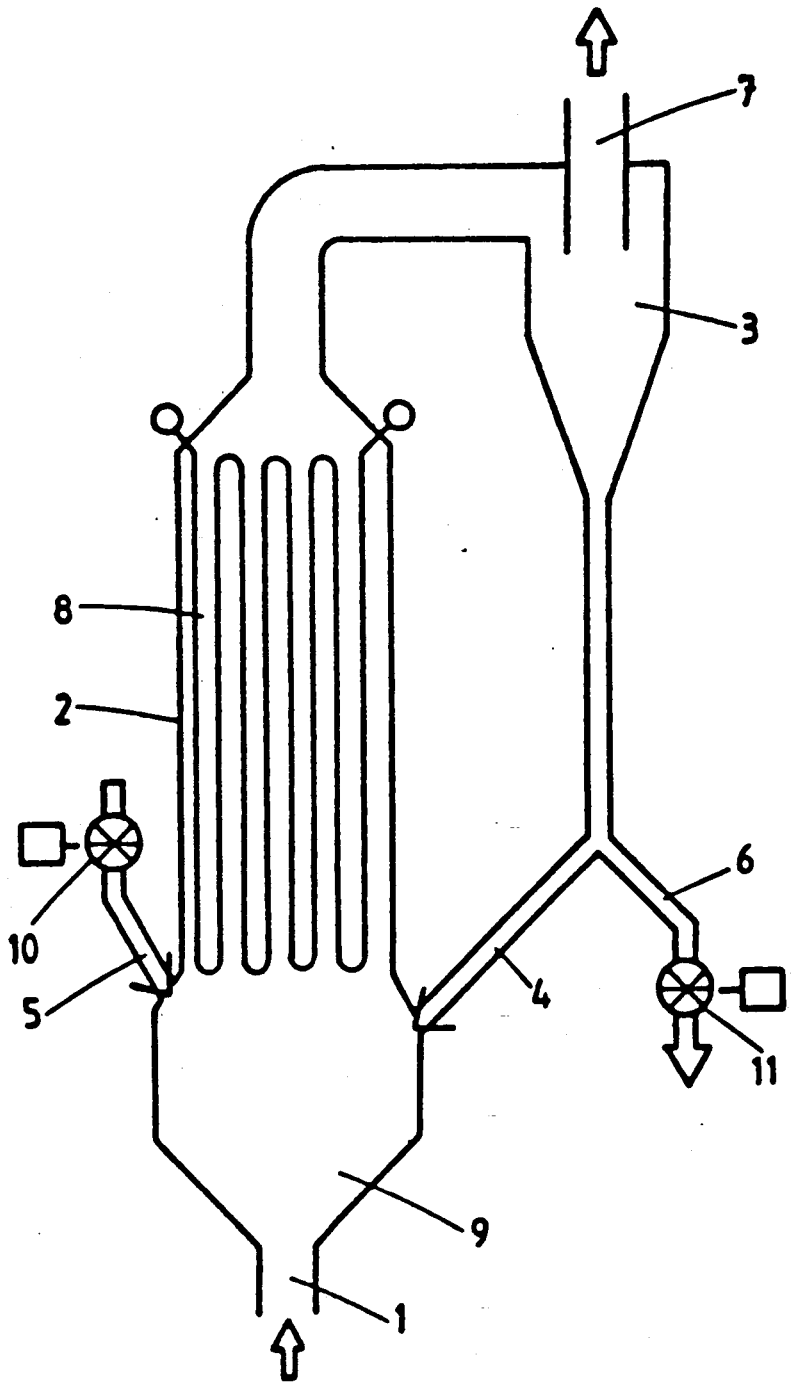
7
3
8
2
6
10
5
4
11
9
1

METHOD FOR CLEANING GASES CONTAINING CONDENSABLE COMPONENTS

This is a continuation of application Ser. No. 06/852,950, filed as PCT FI85/00074 on Aug. 30, 1985, now abandoned.

The present invention relates to a dry cleaning method for gases containing dust and tar generated by a partial oxidation of biomasses, peat or coal and for other gases containing condensable components, in which method the gas is cooled in a fluidized bed reactor provided with cooling surfaces.

The use of solid fuels in applications substituting oil is aggravated by e.g. unorganic compounds (ash) in them and by their slow diffusion combustion which is attributable to the nature of the particles. A "clean" fuel with a low ash content is often required in process industries (driers, lime sludge reburning kilns, production of synthesis gas) for the sake of the quality of the product or for avoiding process troubles. In gas turbines and diesel motors the direct use of solid fuels is restricted by the requirement for total absence of ash and by the slow combustion. Thus it is expedient to bring the fuel into a gaseous condition before exploitation.

Gasifiers based on partial oxidation have originally been simple fixed packed bed/counter-current gasifiers and gas generated by them has been rich in tarlike, organic compounds. Gases containing less tar can be generated by performing a parallel-flow gasification. A parallel-flow gasification has required a transition from fixed packed bed gasifiers to fluidized bed and suspension gasifiers. In a parallel-flow gasification the proportion of contaminants in the product gas changes so that few tars are generated in proportion to solid, finely divided coke. The proportion of tar and coke can effectively be influenced by the final temperature of the gas that is, however, restricted by the melting temperature of fluidized material in the fluidized bed reactor. In fluidized bed gasifiers some of the solids to be gasified flows with the gas and generate tar combinations in the whole area of the gasifying reactor. Tar generated near an outlet does not have time to disintergrate into light hydrocarbons, which further increases the tar content of a product gas. To summarize the stage of the gasification technique today one can say that tar compounds in a product gas form a central restriction for gas applications.

The most usual method for cleaning combustion or synthesis gas is probably the cleaning by means of a liquid, generally water. Water or some other liquid is sprayed into hot or already cooled combustion gas, gas is cooled and cleaned from at least solids and mainly also from tars. Scrubbing is not an efficient method for removing tars since only some tars are water-soluble. Due to capillary action it is impossible to remove the smallest tar drops by scrubbing. In addition to a poor cleaning effect the greatest disadvantages of scrubbing are a great power demand, expensive investments and treatment costs of waste waters.

U.S. Pat. No. 4,198,212 shows a gas cleaning method in which coke and gas containing tar generated by coal gasification are led into a fluidized bed cooling device in which the coke cooled by an indirect method forms a fluidized bed. In this fluidized bed tars from the through flowing gas are condensed.

U.S. Pat. No. 2,538,013 shows a method for removing sublimable components from gas in a fluidized bed reactor provided with cooling surfaces, in which reactor gas and solids suspended into it are cooled mainly in a cooling surface zone. This provides a risk for contamination.

An object of the invention is to accomplish a gas cleaning method which compared with the known method can more easily be controlled according to varying process parameters, and which, furthermore, is suitable for removing except tars also other condensable components e.g. natrium and sulphur compounds from gases.

An almost total separation of condensed tars can be accomplished with the method according to the invention with small investment and running costs and with no cleaning waters that would be detrimental to the environment or would need expensive treatments. The method according to the invention is characterized in that cooling takes place in a circulating bed reactor into which solids separated from the cooled gas and other solids for controlling the function of the reactor are fed and that the heat capacity flow of these solids is so large that it is able essentially to cool the gas to the condensation temperature of the condensable components before the gas is brought into contact with the cooling surfaces.

The invention will be described in detail in the following with reference to the accompanying drawing.

Gas containing tar to be cooled is led through an inlet 1 into a mixing chamber 9 disposed in a lower part of a circulating bed reactor 2. Gases leaving the upper part of the reactor are led into a cyclone separator 3 wherefrom some of the solids separated from the gases are recirculated into the lower part of the reactor through a pipe 4. Also new solids, e.g. sand, are fed into the lower part of the reactor through a pipe 5. In case the gas to be cleaned contains sulphur compounds it is expedient to choose a solid that will bind the sulphur as a sulphide.

Some of the solids separated from the gases are discharged through a pipe 6 for further processing. The gas cleaned from solids is discharged through a central pipe 7 in the separator.

In the fluidized bed reactor the gases with their solids are cooled by means of cooling surfaces 8 to such a temperature that the main part of the tar compounds condense on the solids already in the mixing chamber 9.

The amount of solids flowing through the fluidized bed reactor is controlled by changing the solids flow fed through the pipe 5 and discharged through the pipe 6 by means of rotary feeders 10 and 11. There is no sluice valve or other blocking device in the return pipe 4. Air nozzles can be installed in the pipe by means of which the return flow can be controlled. The temperature and the dwelling time in the reactor are chosen to maximize the cleaning effect.

By means of the additive, i.e. the solids introduced through pipe 5, by changing the grain size and quality of the additive (e.g. particle density), the controllability can be improved and also the heat transfer to the cooling surfaces somewhat influenced.

In order to secure a long dwelling time in the mixing chamber and a large contact area between the circulating solids and the solids to be cooled the free cross section of the flow in the mixing chamber is at least twice the one in the cooling zone of the reactor where the cooling surfaces 8 are disposed.

The flow velocity of the gas in the cooling zone is preferably 2–10 m/s and at the most half of this in the mixing chamber.

The solids density of the suspension in the reactor is preferably 2–20 kg/m$^3$.

The invention is not limited to the above embodiment but it can be modified and applied within the scope of the claims. In some cases the cooling effect of the solids flow through the pipe 5 can be so large that use of the cooling surfaces 8 becomes unnecessary.

I claim:

1. In a circulating fluidized bed reactor having a discrete lower mixing chamber in a lower part of the reactor and a discrete cooling zone, with a smaller cross-sectional area than the mixing chamber, in said reactor spaced above said mixing chamber and the mixing chamber and the cooling zone thus together forming a reactor chamber in the circulating fluidized bed reactor, a method for cleaning hot gases containing substantially predetermined condensable components, comprising the steps of:

(a) directing the hot gases containing the predetermined condensable components into the mixing chamber in said lower part of the circulating fluidized bed reactor, so as to fluidize the bed material in the fluidized bed reactor and transport particles through the mixing chamber and the cooling zone spaced above said mixing chamber;

(b) reducing the temperature of the hot gases in the mixing chamber, substantially by direct heat transfer, by mixing into the hot gases in the mixing chamber solid particles in an amount having a heat capacity sufficient to cool the gases therein essentially to the condensation temperature of substantially the entirety of the predetermined condensable components of the hot gases in the mixing chamber;

(c) directing the mixture of the solid particles and the gases concurrently as a gas-solid suspension having said reduced temperature upwards from the mixing chamber into the cooling zone and with increased velocity through the cooling zone for reducing the temperature of the solid particles and further reducing the temperature of the hot gases;

(d) discharging a mixture of cooled solid particles and gases from the cooling zone of the reactor and separating cooled particles from the gases in a particle separator connected to the outlet of the cooling zone;

(e) recirculating at least a part of the cooled separated particles into the mixing chamber, for cooling the hot gases therein;

(f) feeding additional solid particles into the mixing chamber for increasing the amount of solid particles and thereby the heat capacity flow of the solid particles in the mixing chamber for cooling the hot gases; and (g) controlling the cooling of the hot gases in said mixing chamber by controlling at least the magnitude of one of the flow of the (1) cooled separated particles recirculated and (2) the additional solid particles fed into the mixing chamber thereby to enable the hot gases to be cooled in the mixing chamber to the condensation temperature of substantially the entirety of the predetermined condensable components thereof.

2. A method according to claim 1 including flowing the gases passing through the mixing chamber at a velocity substantially less than the flow velocity of the gases flowing in the cooling zone whereby the flow velocity of the gases in the mixing chamber provides a dwell time therein sufficient to cool the gases in the mixing chamber to the condensation temperature of the condensable components of the hot gases.

3. A method according to claim 2 including the step of contacting gases in the mixing chamber with the solids in the mixing chamber at a flow velocity no greater than one-half of the flow velocity of the gases in the cooling zone.

4. A method according to claim 2 including the step of providing a gas flow velocity in the cooling zone of 2–10 meters per second.

5. A method according to claim 1 including the step of providing the hot gases to be cleaned from a gasifier.

6. A method according to claim 1 wherein the step of controlling the cooling of the gases includes the step of controlling both of the flows of the cooled separated particles recirculated and the additional solid particles into the mixing chamber.

7. A method according to claim 1 wherein controlling the cooling of the gases in the mixing chamber includes controlling the grain size of the particles fed into the mixing chamber.

8. A method according to claim 1 wherein the solid particles fed into the mixing chamber comprise sand.

9. A method according to claim 1 wherein the solid particles fed into the mixing chamber are in part sulphur binding.

10. In a circulating fluidized bed reactor having a discrete lower mixing chamber in a lower part of the reactor and a discrete cooling zone, with a smaller cross-sectional area than the mixing chamber, in said reactor spaced above said mixing chamber and the mixing chamber and the cooling zone thus together forming a reactor chamber in the circulating fluidized bed reactor, a method for cleaning hot gases containing substantially predetermined condensable components, comprising the steps of:

(a) directing the hot gases containing the predetermined condensable components into the mixing chamber in said lower part of the circulating fluidized bed reactor, so as to fluidize the bed material in the fluidized bed reactor and transport particles through the mixing chamber and the cooling zone spaced above said mixing chamber;

(b) reducing the temperature of the hot gases in the mixing chamber, substantially by direct heat transfer, by mixing into the hot gases in the mixing chamber solid particles, in an amount having a heat capacity sufficient to cool the gases therein essentially to the condensation temperature of substantially the entirety of the predetermined condensable components of the hot gases in the mixing chamber;

(c) directing the mixture of the solid particles and the gases concurrently as a gas-solid suspension having said reduced temperature upwards from the mixing chamber into the cooling zone and with increased velocity through the cooling zone for reducing the temperature of the solid particles and further reducing the temperature of the hot gases;

(d) discharging a mixture of cooled solid particles and gases from the cooling zone of the reactor and separating cooled particles from the gases in a particle separator connected to the outlet of the cooling zone;

(e) recirculating at least a part of the cooled separated particles into the mixing chamber, for cooling the hot gases therein;

(f) feeding additional solid particles into the mixing chamber for increasing the amount of solid particles and thereby the heat capacity flow of the solid particles in the mixing chamber for cooling the hot gases; and (g) controlling the cooling of the hot gases in said mixing chamber by controlling the particle density of the solid particles in the mixing chamber thereby to enable the hot gases to be cooled in the mixing chamber to the condensation temperature of substantially the entirety of the predetermined condensable components thereof.

11. A method according to claim 10 including flowing the gases passing through the mixing chamber at a velocity substantially less than the flow velocity of the gases flowing in the cooling zone whereby the flow velocity of the gases in the mixing chamber provides a dwell time therein sufficient to cool the gases in the mixing chamber to the condensation temperature of the condensable components of the hot gases.

12. A method according to claim 10 wherein the step of controlling the cooling of the gases includes the step of controlling both of the flows of the (1) cooled separated particles recirculated and (2) the additional solid particles into the mixing chamber.

13. A method according to claim 10 wherein controlling the cooling of the gases in the mixing chamber includes controlling the grain size of the particles fed into the mixing chamber.

14. A method according to claim 10 including the steps of flowing the gases passing through the mixing chamber at a velocity substantially less than the flow velocity of the gases flowing in the cooling zone whereby the flow velocity of the gases in the mixing chamber provides a predetermined dwell time and mixing into the hot gases in the mixing chamber solid particles, in an amount having a heat capacity in said dwell time to cool the gases in the lower mixing chamber essentially to the condensation temperature of the predetermined condensable components of the hot gases such that substantially the entirety of the predetermined condensable components condense out of the hot gas in the mixing chamber.

15. In a circulating fluidized bed reactor having a discrete lower mixing chamber in a lower part of the reactor and a discrete cooling zone, with a smaller cross-sectional area than the mixing chamber, in said reactor spaced above said mixing chamber and the mixing chamber and the cooling zone thus together forming a reactor chamber in the circulating fluidized bed reactor, a method for cleaning hot gases containing substantially predetermined condensable components, a method comprising the steps of:

(a) directing the hot gases containing the predetermined condensable components into the mixing chamber in said lower part of the circulating fluidized bed reactor, so as to fluidize the bed material in the fluidized bed reactor and transport particles through the mixing chamber and the cooling zone spaced above said mixing chamber;

(b) reducing the temperature of the hot gases in the mixing chamber, substantially by direct heat transfer, by mixing into the hot gases in the mixing chamber solid particles, in an amount having a heat capacity sufficient to cool the gases therein essentially to the condensation temperature of substantially the entirety of the predetermined condensable components of the hot gases in the mixing chamber;

(c) directing the mixture of the solid particles and the gases concurrently as a gas-solid suspension having said reduced temperature upwards from the mixing chamber into the cooling zone and with increased velocity through the cooling zone for reducing the temperature of the solid particles and further reducing the temperature of the hot gases;

(d) discharging a mixture of cooled solid particles and gases from the cooling zone of the reactor and separating cooled particles from the gases in a particle separator connected to the outlet of the cooling zone;

(e) recirculating at least a part of the cooled separated particles into the mixing chamber, for cooling the hot gases therein;

(f) feeding additional solid particles into the mixing chamber for increasing the amount of solid particles and thereby the heat capacity flow of the solid particles in the mixing chamber for cooling the hot gases; and (g) controlling the cooling of the hot gases in said mixing chamber by controlling the grain size of the particles fed into the mixing chamber thereby to enable the hot gases to be cooled in the mixing chamber to the condensation temperature of substantially the entirety of the predetermined condensable components thereof.

16. A method according to claim 15 including flowing the gases passing through the mixing chamber at a velocity substantially less than the flow velocity of the gases flowing in the cooling zone whereby the flow velocity of the gases in the mixing chamber provides a dwell time therein sufficient to cool the gases in the mixing chamber to the condensation temperature of the condensable components of the hot gases.

17. A method according to claim 15 including the steps of flowing the gases passing through the mixing chamber at a velocity substantially less than the flow velocity of the gases flowing in the cooling zone whereby the flow velocity of the gases in the mixing chamber provides a predetermined dwell time and mixing into the hot gases in the mixing chamber solid particles, in an amount having a heat capacity in said dwell time to cool the gases in the lower mixing chamber essentially to the condensation temperature of the predetermined condensable components of the hot gases such that substantially the entirety of the predetermined condensable components condense out of the hot gas in the mixing chamber.

18. In a circulating fluidized bed reactor having a discrete lower mixing chamber in a lower part of the reactor and a discrete cooling zone, with a smaller cross-sectional area than the mixing chamber, in said reactor spaced above said mixing chamber and the mixing chamber and the cooling zone thus together forming a reactor chamber in the circulating fluidized bed reactor, a method for cleaning hot gases containing substantially predetermined condensable components, a method comprising the steps of:

(a) directing the hot gases containing the predetermined condensable components into the mixing chamber in said lower part of the circulating fluidized bed reactor, so as to fluidize the bed material in the fluidized bed reactor and transport particles through the mixing chamber and the cooling zone spaced above said mixing chamber;

(b) reducing the temperature of the hot gases in the mixing chamber, substantially by direct heat transfer, by mixing into the hot gases in the mixing chamber solid particles, in an amount having a heat capacity sufficient to cool the gases therein essentially to the condensation temperature of substantially the entirety of the predetermined condensable components of the hot gases in the mixing chamber;

(c) directing the mixture of the solid particles and the gases concurrently as a gas-solid suspension having said reduced temperature upwards from the mixing chamber into the cooling zone and with increased velocity through the cooling zone for reducing the temperature of the solid particles and further reducing the temperature of the hot gases;

(d) discharging a mixture of cooled solid particles and gases from the cooling zone of the reactor and separating cooled particles from the gases in a particle separator connected to the outlet of the cooling zone;

(e) recirculating at least a part of the cooled separated particles into the mixing chamber, for cooling the hot gases therein;

(f) feeding additional solid particles into the mixing chamber for increasing the amount of solid particles and thereby the heat capacity flow of the solid particles in the mixing chamber for cooling the hot gases; and (g) flowing the hot gases passing through the mixing chamber at a velocity substantially less than the flow velocity of the gases flowing in the cooling zone whereby the flow velocity of the gases in the mixing chamber provides a dwell time therein sufficient to cool the gases in the mixing chamber to the condensation temperature of substantially the entirety of the predetermined condensable components of the hot gases.

19. A method according to claim 18 including the step of contacting gases in the mixing chamber with the solids in the mixing chamber at a flow velocity no greater than one-half of the flow velocity of the gases in the cooling zone.

20. A circulating fluidized bed reactor for cleaning gases containing predetermined condensable components, said apparatus comprising:

(a) means defining a mixing chamber having upstream and downstream portions;

(b) means defining a cooling zone above said mixing chamber and in communication with said downstream portion of said mixing chamber for receiving gases from said mixing chamber through said downstream portion into said cooling zone;

(c) conduit means communicating with said upstream portion of said mixing chamber for directing hot gases through said upstream portion into said mixing chamber into said cooling zone;

(d) a particle separator for separating particles from the cooled gases in said cooling zone;

(e) a return pipe in communication with said particle separator and having a discharge end for feeding at least part of the separated particles into the mixing chamber;

(f) an inlet pipe for feeding additional solid particles into said mixing chamber for direct heat transfer with the gases, whereby the separated particles and the additional particles reduce the temperature of the hot gases in the mixing chamber essentially to or below the condensation temperature of the predetermined condensable components of the hot gases;

(g) cooling surfaces in said cooling zone for reducing the temperature of the mixture of solid particles and pre-cooled hot gases flowing from the mixing chamber into the cooling zone; and (h) the cross-sectional area of said mixing chamber taken across the direction of flow of said hot gases being substantially larger than the cross-sectional area of the cooling zone, whereby the velocity of gas flow through said mixing chamber is substantially less than the velocity of gas flow through said cooling zone thereby enabling a dwell time for the solid particles and gases in said mixing chamber sufficient to cool the gases in said mixing chamber to the condensation temperature of the predetermined condensable components of the hot gases.

21. A reactor according to claim 20 wherein the mixing chamber is free of cooling surfaces other than the solid particles disposed therein.

* * * * *